United States Patent [19]

Washa

[11] Patent Number: 4,977,010

[45] Date of Patent: Dec. 11, 1990

[54] STRIPS OF CAME AND METHOD FOR PRODUCING THE SAME

[76] Inventor: John G. Washa, 5767 Vinley Pl., San Diego, Calif. 92120

[21] Appl. No.: 272,918

[22] Filed: Nov. 18, 1988

[51] Int. Cl.[5] ..... B32B 3/02; B32B 15/08

[52] U.S. Cl. ..... 428/83; 428/457; 428/461

[58] Field of Search ..... 428/465, 462, 457, 461, 428/83; 52/397, 823, 716

[56] References Cited

U.S. PATENT DOCUMENTS 4,291,076 9/1981 Katoh ..... 428/465 X 4,389,271 6/1983 Shandy et al. ..... 428/465 X

*Primary Examiner*—Thomas J. Herbert

*Attorney, Agent, or Firm*—Charles C. Logan, II

[57] ABSTRACT

The elongated strips of came have a U-shaped cross section or an H-shaped cross section. An elongated strip of resilient cushion layer having an adhesive coating on its top surface is pressed into mating contact with the inside surface of the came. The resilient cushion layer functions to prevent chatter or rattle of glass panes that have their edge surface inserted into the came strips. The came acts like a bony skeleton to hold individual pieces of glass pane together in an assembly such as found in book cases and stained glass windows.

2 Claims, 1 Drawing Sheet

STRIPS OF CAME AND METHOD FOR PRODUCING THE SAME

BACKGROUND OF THE INVENTION

The invention relates to structure for holding individual glass panes together in a predesigned assembly. More specifically the invention relates to an improved strip of came. Lead and brass came are the chief support of works of stained glass and glass panels for bookcases. Like the bony skeleton, it is rigid where essential, yielding where necessary, compliant always. Such cames are generally available in six foot lengths of varied dimensions and design.

The word "came" is an Old English word meaning "string" or "length". It is also occasionally spelled "calme". The lead cames used with stained glass assemblies are made by an extrusion process. The die channels and shapes them.

While other materials have come into use, such as zinc bars, copper foil, brass rods, etc, lead is still the basic material that shapes stained glass creations.

The came serves a dual purpose. Basically, it holds the different pieces of glass together to conform to a pre-existing pattern or design. It also forms of itself a geometric or abstract design or, indeed, a pictoral design, which in an overview, can add to or detract from the creative endeavor.

Came is always measured across the top surface, not cross the channeled side, nor is the depth of the channel necessarily a factor in measuring the came. Since the channel may be pinched or enlarged, such a measurement would be inconstant. The top surface, however, does not change to any degree, and it is here that we measure whether the came is 1/16, ⅛, 3/16, ½ inch, etc. Hobbyists generally stay in the range of 1/16 to ¼ inch came. Whether the came is described as round or flat applies also to the description of the top surface. Most lead cames come either way.

H cames have two channels, one on either side with a wall or "heart" in the middle, and are shaped like an H on its side. They are used within a panel or window. U cames or "high heart" cames are outside cames used for finishing off a single surface that will show, as in hanging panels or the skirts of lamps, they have only one channel which is considerably deeper than the H channel and their use gives a completed look to a panel or window, the edges of which will not be covered by molding.

SUMMARY OF THE INVENTION

Applicant's novel improved strips of came have been designed to eliminate the chatter or rattle which is present in applications such as bookcases where multiple panels of glass are attached to each other with strips of came holding them in position. Due to inaccurate dimensions to the adjoining glass panes, there is.often a looseness of fit that results in chatter or rattle when the window assembly is moved or even in its stationary state when subjected to external vibrations. Presently it is necessary to putty or glaze a channel to eliminate this problem. This is a time consuming and costly operation during the assembly. Applicant's improved strips of came eliminate the need for adding putty or glazing by having an elongated strip of resilient cushion layer having an adhesive coating on its top surface pressed into mating contact with the inside surface of the top wall of the strip of came. This strip of resilient cushion aids to waterproof, soundproof, and strengthening the fitting between the glass panes and the came.

The resilient cushion layer is preferably made of neoprene, polyvinyl chloride, polyethelene or an closed-cell foam. It would be approximately 1/32 inch thick and it would have a compression ratio of approximately 6:1. By having the resilient cushion layer already applied to the strips of came when they are purchased, the time consuming step of glazing or adding putty to the came is eliminated.

Applicant's improved process of forming U-shaped brass came strips with a resilient cushion layer adhered to the inside surface of the came will now be described. An elongated flat strip of brass material is passed through a die roller assembly which forms it into U-shaped came. As the came exits the die roller assembly, an elongated strip of resilient cushion layer having an adhesive coating on its top surface is pressed into mating contact with the inside surface of the strip of came.

The H came has two channels, one on either side with a wall or "heart" in the middle, and it is shaped like an H on its side. The applicant takes round H came made of lead that comes on a reel and passes it along his production line on its side. He then takes a pair of strips of flat brass packaged on a reel and sets them up with one on each lateral side of the H came. The strips of brass are then fed through a series of dies on the respective lateral sides of the H came and pressed onto the respective outer walls. As the production line continues on, a pair of elongated strips of resilient cushion layer having an adhesive coating on its top surface is pressed into mating contact with the respective sides of the wall or "heart" formed in the middle of the H came.

DESCRIPTION OF THE PREFERRED EMBODIMENT

Figure 1:
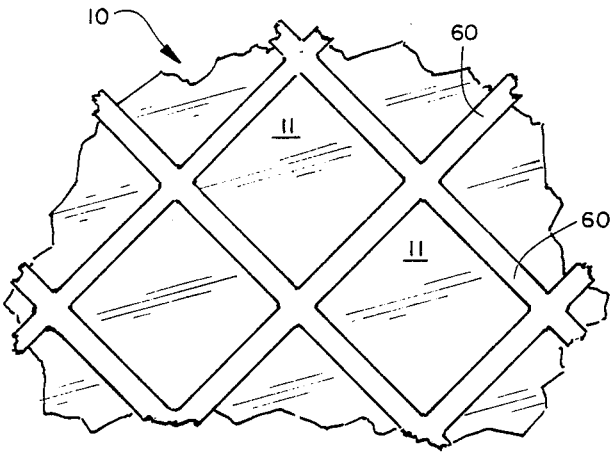
FIG. 1 is a partial elevation view illustrating a glass pane assembly formed from multiple glass panes that are supported and held together by came strips.
Figure 3:
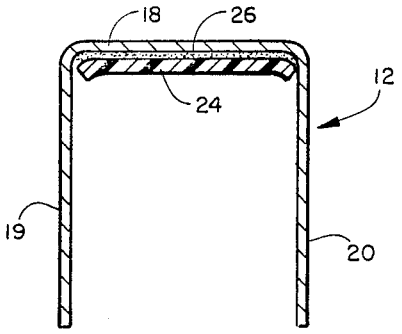
FIG. 3 is a cross sectional view taken along lines 3—3 of FIG. 2.
Figure 2:
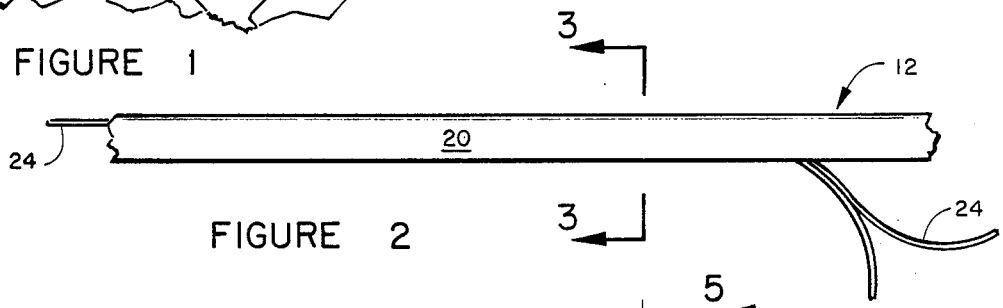
FIG. 2 is a side elevation view of an elongated strip of applicant's novel came.

Applicant's novel improved strips of came and his process for forming the same will now be decribed by referring to FIGS. 1–5 of the drawing.

In FIG. 1 the window assembly 10 is illustrated being formed from multiple glass panes 11 that have their edges grasped by H-shaped came strips 60.

The improved U-shaped strips of came 12 have a top wall 18, and downwardly extending side walls 19 and 20. A cushion layer strip 24 having a tacky adhesive 26 on its top surface is pressed into contact with the inside surface of top wall 18.

Figure 4:
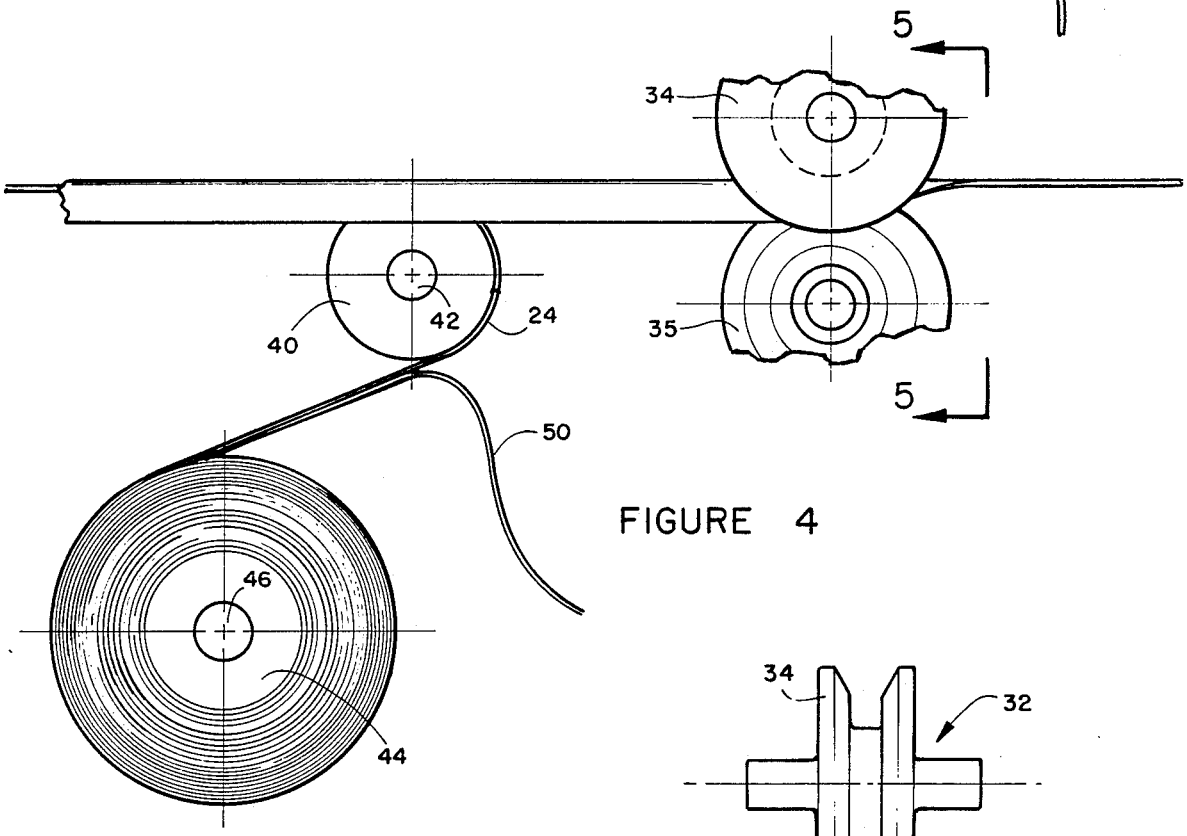
FIG. 4 is a side elevation view illustrating the process of forming U-shaped brass came strips with a resilient cushion layer adhered to the inside surface of the came.
Figure 5:
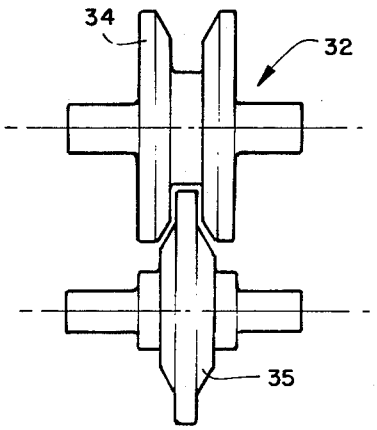
FIG. 5 is an end elevation view taken along lines lines 5—5 of FIG. 4.

When improved strips of brass came are made, the process illustrated in FIG. 4 and 5 is utilized. An elongated flat strip of brass 30 is inserted through die roller assembly 32 which has an upper roller die 34 and a lower roller die 35. One of these roller dies may be connected to conventional rotational driving apparatus. The U-shaped came 12 exits the die roller assembly 32 then passes over a roller platen 40 that is mounted on a shaft 42. A roll of elongated strip of resilient cushion layer 24 is mounted on a spool 44 that is supported on a roller 46. The tacky adhesive surface 26 of the cushion layer strip 24 has a strip of release paper 50 covering it. As the cushion layer strip 24 passes from spool 44, the strip of release paper 50 is deflected away and only the cushion layer strip 24 passes around roller platen 40 where it is then pressed into mating contact wiht the inside surface of top wall 18 of the U-shaped came.

Figure 6:
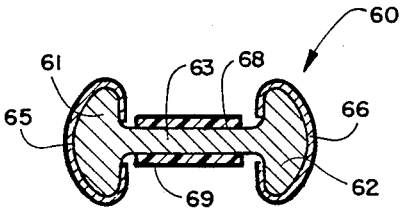
FIG. 6 is a cross sectional view of H came with a strip of resilient cushion layer pressed onto opposite sides of said middle wall or "heart".

The H came that has applicant's novel manufacturing process performed on it is illustrated in a cross sectional view in FIG. 6. It has side walls 61 and 62 and a middle wall or "heart" 63. The core of the H came 60 is made of lead and it has strips of brass 65 and 66 that have been pressed onto the round outer surfaces of the respective side walls 61 and 62. The cushion layer strips 68 and 69 are pressed onto the opposite surfaces of middle wall 69.

What is claimed is :

1. Improved strips of came comprising:

an elongated strip of came having a U-shaped cross section having a top wall and laterally spaced downwardly extending side walls, said top wall having an inside surface;

an elongated strip of resilient cushion layer having an adhesive coating on its top surface and this top surface is pressed into mating contact with the inside surface of said strip of came;

said strip of resilient cushion layer is made of neoprene material and it has a 6:1 compression ratio; and said strip of resilient layerr is substantially 1/32 inch thick.

2. Improved strips of came comprising:

an elongated strip of came having a H-shaped cross section having a pair of laterally spaced side walls connected together by a middle wall, said middle wall having an outer surface on each of its opposite sides;

a pair of elongated strips of resilient cushion layer each having an adhesive coating on its top surface and this top surface is pressed into mating contact with the respective outer surfaces of said middle wall;

said strips of resilient cushion layer being made of neoprene material and having a 6:1 compression ratio; and said strips of resilient cushion layer are substantially 1/32 inch thick.

* * * * *